US006953126B2

(12) United States Patent
Parker et al.

(10) Patent No.: US 6,953,126 B2
(45) Date of Patent: Oct. 11, 2005

(54) PROTECTIVE CASE

(75) Inventors: David H. Parker, Torrance, CA (US); John Hoven, Manhattan Beach, CA (US); Kevin Deighton, Long Beach, CA (US)

(73) Assignee: Pelican Products, Inc., Torrance, CA (US)

( * ) Notice: Subject to any disclaimer, the term of this patent is extended or adjusted under 35 U.S.C. 154(b) by 0 days.

(21) Appl. No.: 10/719,309

(22) Filed: Nov. 21, 2003

(65) Prior Publication Data

US 2004/0099497 A1 May 27, 2004

Related U.S. Application Data

(63) Continuation of application No. 10/001,652, filed on Oct. 31, 2001, now Pat. No. 6,698,608.

(51) Int. Cl.[7] ..... B65D 6/28
(52) U.S. Cl. ..... 220/4.22; 220/495.01
(58) Field of Search ..... 220/495.01, 4.22–4.24, 220/23.87, 849, DIG. 27, 324, 772, 378; 206/550

(56) References Cited

U.S. PATENT DOCUMENTS

| | | | |
|---|---|---|---|
| 2,565,939 | A | 8/1951 | Wriston |
| 3,133,664 | A | 5/1964 | Koch et al. |
| 4,034,889 | A | 7/1977 | Hammes et al. |
| 4,454,889 | A | 6/1984 | Contreras, Sr. |
| 4,465,189 | A | 8/1984 | Molzan |
| D275,822 | S | 10/1984 | Gatland et al. |
| D279,429 | S | 7/1985 | Stolarz |
| 4,615,464 | A | 10/1986 | Byrns |

(Continued)

FOREIGN PATENT DOCUMENTS

| | | |
|---|---|---|
| WO | WO 99/21454 | 5/1999 |

OTHER PUBLICATIONS

Two pages from www.pelican.com depicting Pelican Products cases.

*Primary Examiner*—Joseph C. Merek
(74) *Attorney, Agent, or Firm*—Charles Berman; Greenberg Traurig LLP

(57) ABSTRACT

A protective case which includes two mating case components and a liner extending between a peripheral area for mating engagement to ensure a relatively sealed relationship when the case components are closed. A latch face is a single elongated element on the front and has two spaced interlocking components to cooperate with hooks in the opposite case component.

17 Claims, 3 Drawing Sheets

U.S. PATENT DOCUMENTS

| | | | | |
|---|---|---|---|---|
| D294,080 | S | | 2/1988 | Golia et al. |
| 4,743,038 | A | | 5/1988 | Myers et al. |
| D299,590 | S | | 1/1989 | Omino |
| 4,915,913 | A | | 4/1990 | Williams et al. |
| 4,915,918 | A | | 4/1990 | Nichols |
| 5,040,834 | A | | 8/1991 | Kahl et al. |
| D319,731 | S | | 9/1991 | Reynolds, Jr. et al. |
| 5,065,885 | A | | 11/1991 | Scaroni |
| D324,165 | S | | 2/1992 | Bressler et al. |
| 5,092,458 | A | | 3/1992 | Yokoyama |
| 5,095,657 | A | * | 3/1992 | Marsh ..... 49/492.1 |
| D325,819 | S | | 5/1992 | Lee |
| D335,030 | S | | 4/1993 | Alfonso |
| D339,227 | S | | 9/1993 | Fritze et al. |
| D347,324 | S | | 5/1994 | Dickinson |
| 5,353,946 | A | | 10/1994 | Behrend |
| D353,048 | S | | 12/1994 | VanSkiver et al. |
| D360,527 | S | | 7/1995 | Corney et al. |
| D367,558 | S | | 3/1996 | Lai |
| 5,505,328 | A | | 4/1996 | Stribiak |
| D370,619 | S | | 6/1996 | Hall et al. |
| D374,772 | S | | 10/1996 | Hotaling et al. |
| 5,695,087 | A | | 12/1997 | Tutton et al. |
| 5,769,260 | A | | 6/1998 | Killinger et al. |
| D401,408 | S | | 11/1998 | Sun et al. |
| 5,881,874 | A | | 3/1999 | McKinney |
| D407,899 | S | | 4/1999 | Oakes et al. |
| D411,662 | S | | 6/1999 | Carter |
| D413,202 | S | | 8/1999 | Schmitt et al. |
| D413,203 | S | | 8/1999 | Zurwelle et al. |
| D419,297 | S | | 1/2000 | Richardson et al. |
| D419,767 | S | | 2/2000 | Richardson et al. |
| D419,768 | S | | 2/2000 | Richardson et al. |
| D420,796 | S | | 2/2000 | Haddock et al. |
| D421,182 | S | | 2/2000 | Lee |
| D421,525 | S | | 3/2000 | Lee |
| D423,772 | S | | 5/2000 | Cooper et al. |
| 6,085,759 | A | | 7/2000 | Joulia |
| D429,884 | S | | 8/2000 | Zurwelle et al. |
| 6,186,152 | B1 | | 2/2001 | Gueret |
| 6,217,835 | B1 | | 4/2001 | Riley et al. |
| 6,293,286 | B1 | | 9/2001 | Gueret |
| 6,415,947 | B1 | | 7/2002 | Kim |
| D462,519 | S | | 9/2002 | Gaydos et al. |
| 6,698,608 | B2 | * | 3/2004 | Parker et al. ..... 220/4.22 |

* cited by examiner

PROTECTIVE CASE

This is a continuation of Application Ser. No. 10/001,652, filed Oct. 31, 2001, now U.S. Pat. No. 6,698,608.

BACKGROUND OF THE INVENTION

Field of the Invention

This invention relates in general to a protective case. In particular, it is concerned with a case which permits for effective shock absorbance to components contained in the case.

Many different carrying cases are known for containing and protecting components. The different cases have different characteristics, each with different limitations. These cases do not have an effective closure and latching characteristics operable in a useful and easy manner, and do not necessarily provide for effectively sealing the container in an easy manner.

The present invention is directed to providing a suitable protective case for securely and sealingly carrying components. The case also permits for relatively straightforward and positive latching with components which are easier to use than latches in known cases. The case seeks to overcome the limitations of known cases.

SUMMARY OF THE INVENTION

According to the invention, there is provided a carrying case which includes a body having two mating components and a peripheral area for mating engagement to ensure a relatively sealed relationship when the components are closed. A liner material conformingly fits in the space formed by the components. The liner material has a conforming fit and preferably provides a sealing component for the peripheral area between the two mating components. The peripheral edge of the liner is arranged for location in the peripheral area between the two mating components.

An elongated latch is provided which extend substantially across about half of the length of the front of the case. The latch includes a face member extending at least about half the length of the front. There are two spaced locking members for releasably engaging interlocking elements mounted on one of the components, and the latch is hingedly mounted on the other component.

The two elements of the body are mating upper and lower components. Each is made of relatively rigid material, and each has a peripheral formation to engage the mating peripheral formation of the other component. Two spaced hinges are located along the back to permit opening and closure. A handle is located on one of the elements at a side between the front and the back of the case.

A purge valve permits for ingress and egress of pressure to equilibrate the pressure between the inside and the outside of the body.

The foregoing and other objects, features, and advantages of the present invention will be apparent from the following detailed description of the preferred embodiments which makes reference to several drawing figures.

DETAILED DESCRIPTION OF THE PREFERRED EMBODIMENT

Figure 1:
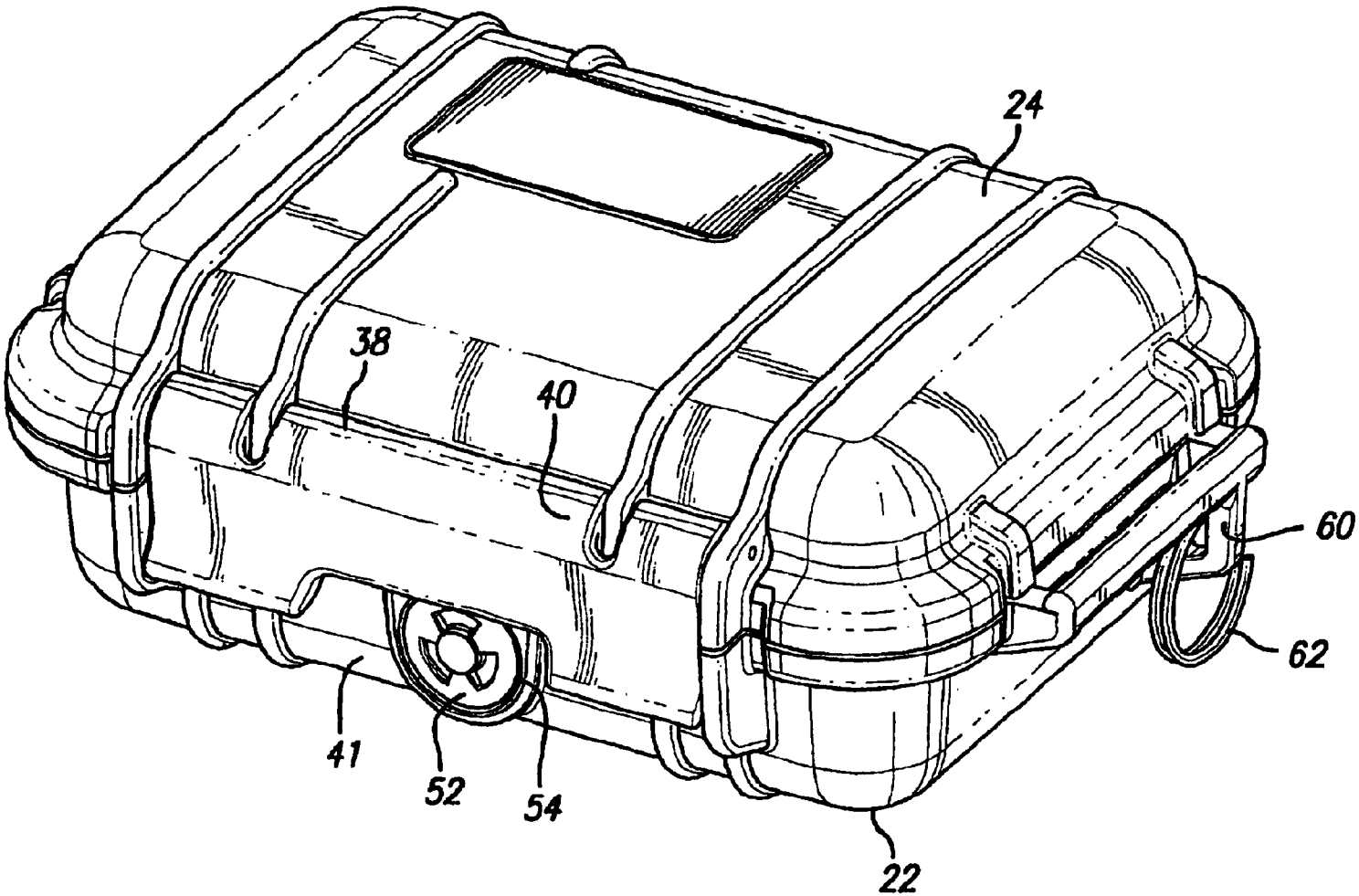
FIG. 1 is a perspective view of one form of a case according to the invention with a base component and a top component shown in closed relationship.
Figure 2:
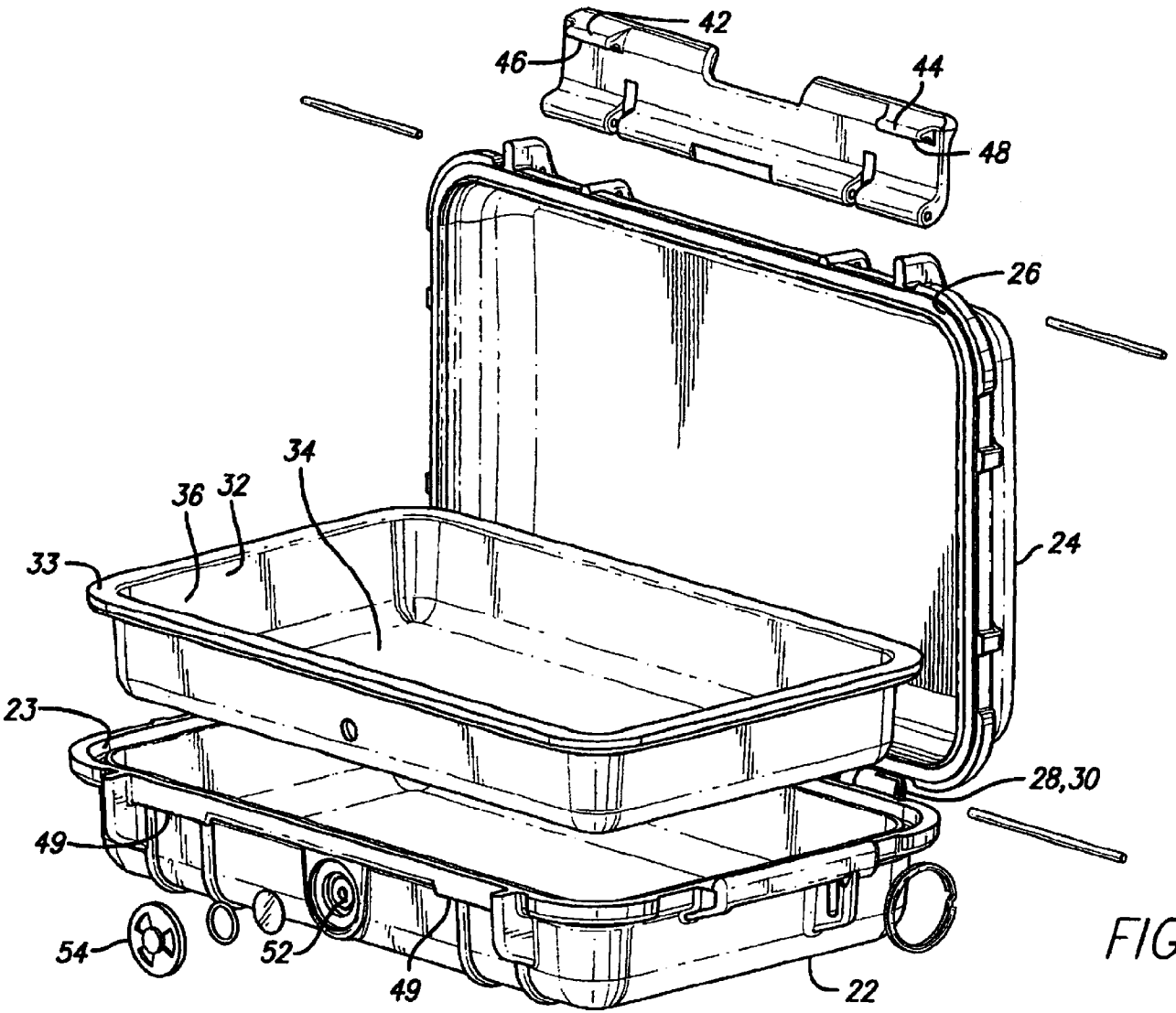
FIG. 2 is an exploded view of the different components of the case showing a liner insert which fits within the case separate from the two components of the case.
Figure 3:
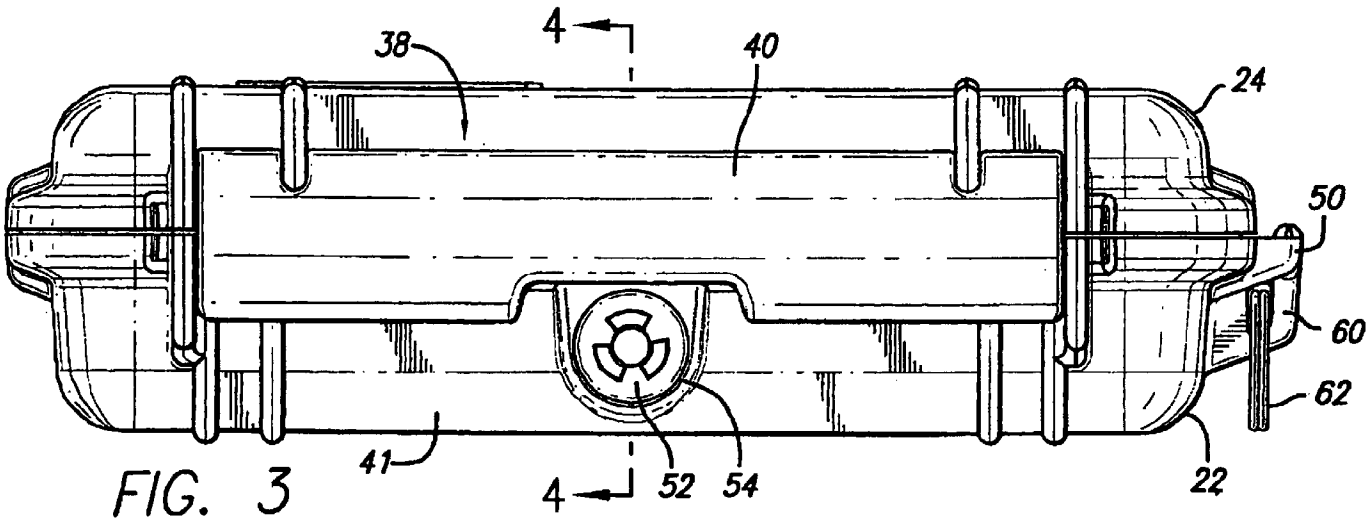
FIG. 3 is a front view of the case.
Figure 5:
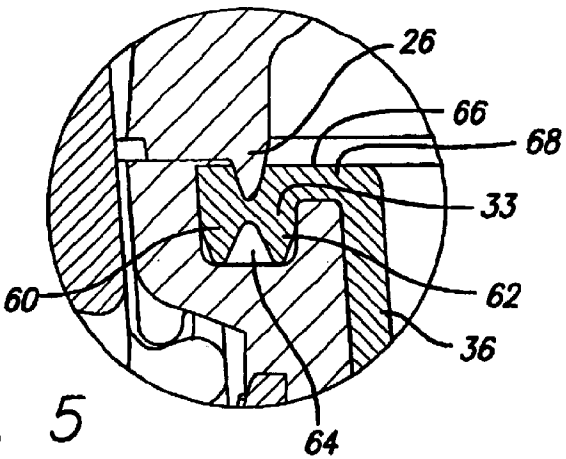
FIG. 5 is an enlarged view of the sealing formations between the top and the bottom portions of the case.
Figure 4:
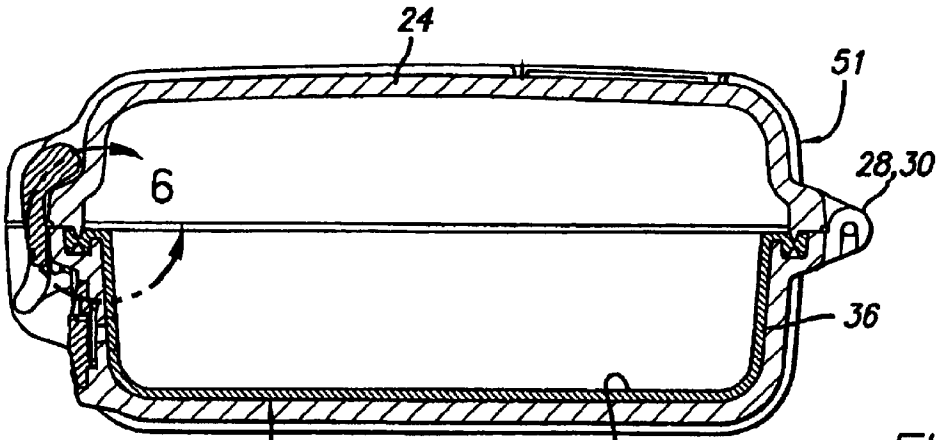
FIG. 4 is a cross-sectional view of the case at the location in the middle of the latch.

In the following description of the preferred embodiments reference is made to the accompanying drawings which form the part thereof, and in which are shown by way of illustration of specific embodiments in which the invention may be practiced. It is to be understood that other embodiments may be utilized and structural and functional changes may be made without departing from the scope of the present invention.

A carrying case 20 includes two mating components 22 and 24 which forms surrounding material for the case. The top component 24 includes a peripheral lip 26 extending around the periphery for mating engagement with a peripheral slot 29 on the bottom component 22 to ensure a relatively closed relationship when the components 22 and 24 are closed. The opening and closure of the components 22 and 24 provide access to a space defined by the surrounding material or closure to the space. The two components 22 and 24 are each made of a relatively rigid polycarbonate plastic material. A pair of hinges 28 and 30 are located along a first side, namely the back side, 51, to permit opening and closure.

A liner material 32 fits in the space in the surrounding material formed by the components 22 and 24. The liner material 32 has a base 34 and an inner peripheral wall 36. The liner material 32 is shaped to conform substantially to the inside of one of the components 22. There is a peripheral edge 33 around the liner 32 which fits snuggly into the peripheral slot 29. The peripheral edge 33 has two legs 60 and 62 which are spaced apart so that there is a space 64 between legs 60 and 62. When the lip 26 engages and forces down on the face 66 of the edge 33 there is a deformation which is achieved, and the extra space 64 can thereby become smaller. This interaction creates an effective sealing interengagements. There is a bringing lateral portion 68 between the edge portion 33 and the walls 36 of the insert 32.

There is a single latch 38 to secure the two components 22 and 24 together in a closed relationship. The latch 38 includes a single face member 40 which extends to at least about, and preferably more than half the length of the front 41 of the case. There are a pair of locking members 42 and 44 which are spread apart towards the ends of the face hook like formations 49 on the opposite component 22. This latch structure 38 by extending over a large length of the front of the case is easy to operate both to open or close. The two locking elements 42 and 44 at the end are spaced apart sufficiently to give an effective locking pressure appropriately distributed over the interface of the components on the front of the case.

The latch 38 is located on element 24 and permit hook latching with mating component on element 22. Effectively, the single face 40 for the latch 38 is user friendly and is easier to use than separate latch elements. Only a single motion or step to move the face 40 is necessary to effect the double latching 42–49 and 44–49. Prior art cases require each latch to be activated to closure or disengagement seperately.

A handle 50 for pulling or carrying the case is located on one of the components 22 on a side between the back 51 and the front 41. The handle 50 is suitably molded as part of component 22.

A purge valve 52 permits for ingress and egress of pressure to equilibrate the pressure between the inside and the outside of the case. The purge valve in the body permits equilibration of pressure. The valve is mounted in one wall of the component 22, and preferably inhibits passage of moisture through the valve, while permitting passage of air. A purge knob 54 is also provided to cooperate with valve 52.

Many modifications and variations are possible in light of the above teaching. For instance instead of the tight sealing arrangement of the components using the liner edge 33, there can instead be an O-ring which is used to conform to the space between the end of the lip 26 and the peripheral slot 29 in a manner to provide sealing between the components. The liner hereby forms a double function, not only as a protective liner, but it also acts as part of the sealing arrangement.

Instead of the liner 32 being molded to fit snuggly with the entire perimeter outer walls of the case, the liner insert 32 may only be in part of one component of the case, namely where the liner 32 is used at the peripheral edge. There could be several separate components making up the liner 32. Also, in some situations, the purge valve may not be used in every embodiment of the case. In other situations there may be only a single latch and a different hinge formation, for instance a piano hinge.

By having a fairly rigid outside component structure to the case, together with a liner removal insert conforming to whole or part of the interior there is provided an effective protective case with a high level of sealing closure to house components. The shape of the interior of the liner can be formed to effectively accommodate different elements to prevent undue movement of the elements to be carried. One or more additional inserts to prevent shock absorbance can be provided inside the liner insert. The outer components can be transparent, translucent, opaque or colored as required. The liner can be similarly formed with different colors and/or transparency or translucency characteristics.

On the side of the case there is also provided means 60 for anchoring a movable ring 62 to permit the case to be carried in a different manner.

The foregoing is a description of the preferred embodiments of the invention and has been presented for the purposes of illustration and description. It is not intended to be exhaustive or to limit the invention to the precise form disclosed.

What is claimed is:

1. A carrying case comprising:

a body of surrounding material having at least two components for opening and closure together thereby to provide access to a space defined by the surrounding material, each component has an edge for location adjacent a respective edge of the opposite component;

a single liner fitting in the space in the surrounding material, the single liner having an edge for location between the component edges thereby to permit a sealing engagement to be effected when the components are closed and the component edges contact the single liner on opposite sides;

means to secure the two components together in a closed relationship;

a latch for location between the two components, the latch being mounted on the side opposite a hinge between the two components; the latch including an elongated face component, the face component extending for about half the length of the front of the case, the latch face shaped such that it has two lips extending outward on either side to allow a finger of a user to lift the latch; and a pair of interlocking elements on the latch component, the interlocking elements being spaced towards the end of the face component, and a pair of cooperating look elements on the second component;

wherein the liner material is shaped to conform substantially to the inside of one of the components and the liner having an opening to facilitate purging from the container.

2. A case as claimed in claim 1 wherein the liner includes a side wall for extending substantially with a side wall of at least one component and a lateral extension from the side wall, the lateral extension being directed towards the edge of at least one component, and wherein, when the components are closed, the lateral extension or a further extension of the lateral extension is located between the respective edges thereby to form a seal for the case.

3. A protective case comprising:

a body of surrounding material having at least two mating components for opening and closure thereby to provide access to a space defined by the surrounding material, each component having a respective edge for location adjacent an edge of the opposite component;

a hinge located along a first side of the two components to permit opening and closure;

a latch for securing the two components in a closed position, the latch being fastened to a first component on the side opposite the hinge and extending in the front of the case, the latch including a face and a locking member, the locking member being for releasably engaging a second component; and a liner including a side wall for extending substantially with a side wall of a first of said components and a lateral extension from the side wall, the lateral extension being directed towards the edge of the first component, and wherein when the first and the second components are closed, the lateral extension or a further extension of the lateral extension is located between the respective edges of the first and second components thereby to form a seal for the case, and wherein a liner edge includes two legs which are spaced apart so that there is a space between the legs and being such that when a lip on the edge of the second component presses against lateral edge the space between the legs becomes smaller.

4. A carrying case as claimed in claim 3 wherein both components are made of translucent or at least partially translucent material, and wherein the liner is opaque.

5. A carrying case comprising:

a body of surrounding material having at least two mating components for opening and closure thereby to provide access to a space defined by the surrounding material, each component having a respective edge for location adjacent an edge of the opposite component;

a hinge located along a first side of the two components to permit opening and closure;

a latch for securing the two components in a closed position, the latch being fastened to a first component on the side opposite the hinge and extending in the front of the case, the latch including a face and a locking member, the locking member being for releasably engaging a second component; and a liner including a side wall for extending substantially with a side wall of a first of said components and a lateral extension from the side wall, the lateral extension being directed towards the edge of the first component, and wherein when the first and the second components are closed, the lateral extension or a further extension of the lateral extension is located between the respective edges of the first and second components thereby to form a seal for the case, and wherein a liner edge includes two legs which are spaced apart so that there is a space between the legs and being such that when a lip on the edge of the second component presses against lateral edge the space between the legs becomes smaller, the liner having an opening to facilitate purging.

6. A carrying case as claimed in claim 1, wherein both components are made of translucent or at least partially translucent material, and wherein the liner is opaque.

7. A carrying case as claimed in claim 5, wherein both components are made of translucent or at least partially translucent material, and wherein the liner is opaque.

8. A case as claimed in claim 3 wherein the liner is a single liner fitting in the space in the surrounding material.

9. A case as claimed in claim 3 wherein the latch includes an elongated face component, the face component extending in front of the case and an interlocking element on the latch component, and a cooperating lock element on the second component.

10. A case as claimed in claim 7 the face component extending for about half the length of the front of the case, and the latch face shaped such that it has two lips extending outward on either side to allow a finger of a user to lift the latch; and a pair of interlocking elements on the latch component, the interlocking elements being spaced towards the end of the face component, and a pair of cooperating lock elements on the second component.

11. A carrying case as claimed in claim 5, wherein the liner includes an opening to facilitate purging.

12. A case as claimed in claim 5, wherein the liner is a single liner fitting in the space in the surrounding material.

13. A case as claimed in claim 5, wherein the latch includes an elongated face component, the face component extending in front of the case and an interlocking element on the latch component, and a cooperating lock element on the second component.

14. A case as claimed in claim 5, the face component extending for about half the length of the front of the case, and the latch face shaped such that it has two lips extending outward on either side to allow a finger of a user to lift the latch; and a pair of interlocking elements on the latch component, the interlocking elements being spaced towards the end of the face component, and a pair of cooperating lock elements on the second component.

15. A case comprising:

a first component and a second component, each comprising a main body and an edge, the edge of the first component being for engagement with the edge of the second component, the edge of the first component having an engagement surface; and a liner located on the edge of the first component, the liner comprising legs facing the engagement surface;

wherein the components are connected so that the case can assume an open condition and a closed condition, in the open condition a liner space is formed between the legs of the liner located on the edge of the first component, in the closed condition the edge of the second component engages the edge of the first component, the legs of the liner located on the edge of the first component are extended so that the space between the legs is reduced.

16. The case of claim 15, wherein the main body of each component has an internal surface, the internal surface of each component defining an internal space of the case, the liner located along the internal surface of the first component.

17. The case of claim 16, further comprising a valve allowing pressure equilibration between the internal space of the case and a space outside the case when the case is in a closed condition.

* * * * *